United States Patent [19]

Heitz

[11] 4,181,160

[45] Jan. 1, 1980

[54] METHOD AND SYSTEM FOR CHECKING THE INTRODUCTION OF A FILLER PIPE INTO A TANK

[75] Inventor: Pierre Heitz, Puteaux, France

[73] Assignee: Copagnie d'Etudes et de Realisation de Cybernetique Industrielle, Paris, France

[21] Appl. No.: 905,441

[22] Filed: May 12, 1978

[30] Foreign Application Priority Data

May 16, 1977 [FR] France ..... 77 14983

[51] Int. Cl.[2] ..... B65B 3/04; B67C 3/34

[52] U.S. Cl. ..... 141/1; 137/553; 141/98; 141/374; 141/392

[58] Field of Search ..... 73/37; 137/553; 141/1, 141/94–96, 98, 284, 374, 392; 220/85 S, 85 F, 86 R

[56] References Cited

U.S. PATENT DOCUMENTS

| | | | |
|---|---|---|---|
| 2,802,483 | 8/1957 | Davis | 137/553 |
| 3,812,890 | 5/1974 | Haas et al. | 141/94 |
| 3,924,666 | 12/1975 | Raison | 141/374 X |

*Primary Examiner*—Frederick R. Schmidt

*Attorney, Agent, or Firm*—Haseltine, Lake & Waters

[57] ABSTRACT

In filling a tank, e.g. of a lorry or wagon, with a liquid, particularly a hydrocarbon, by lowering a pipe under the control of a double acting hydraulic jack into the tank to the bottom and then supplying the liquid to the pipe, the volume of hydraulic fluid flowing to the jack is measured during lowering movement of the pipe, the measurement is converted into a signal representing the position of the end of the pipe and the signal is compared with a reference signal representing the position of the bottom of the tank, so that the operator can check whether the pipe has reached the bottom of the tank.

5 Claims, 2 Drawing Figures

METHOD AND SYSTEM FOR CHECKING THE INTRODUCTION OF A FILLER PIPE INTO A TANK

This invention relates to a method of checking the introduction of a filler pipe into a tank and a safety system for performing the method.

The invention applies more particularly to installations for filling tanks, such as lorries or tankwaggons, with liquid hydrocarbons. In petroleum refineries, installations for filling tank waggons with liquid products produced by the refinery generally consist of filler pipes mounted for vertical movement on a support so as to be introduced into the tank. To this end, the filler pipe frequently consists of two telescopic parts, a fixed part to which a fluid product supply pipe is connected, and a movable part fixed to means for vertical movement, which may be a double-acting jack controlled by a hydraulic circuit having two supply pipes for the two jack chambers for controlling the downward movement of the pipe for its introduction into the tank and its upward movement respectively.

In order, more particularly, to avoid foaming, the pipe must be introduced as far as the tank bottom. During its introduction the pipe may encounter obstacles, e.g. the inner fittings of the tank, or devices disposed inside the tank. For this reason the introduction of the pipe should be stopped as soon as it meets an obstacle or when it reaches the tank bottom. To this end, means for detecting a pressure rise, frequently called a pressostat, is provided in the hydraulic circuit, and preferably in the line controlling the introduction of the pipe, such pressure detection means causing immediate stoppage of introduction of the filler pipe when it detects a rapid pressure rise.

Such a system may be considered as having inadequate safety because of the inertia of the system, but it has been found that this disadvantage should not be exaggerated since special arrangements enable the inertia of the moving masses to be reduced. Also, the main effect of the hydraulic jack is to decelerate the downward movement of the filler pipe under the effect of its own weight and stoppage of the pipe in the event of an excess pressure can therefore be practically immediate.

This arrangement also has the advantage of very great simplicity. However if the introduction of the pipe is stopped when it meets an obstacle the operator may incorrectly think that the pipe has reached the tank bottom and that he can open the filling or charging valve.

It is an object of the invention to provide a method and safety system whereby the position of the pipe can be checked so that the charging valve is opened only when the end of the pipe has reached the tank bottom.

It is a further object of the invention to provide a method of operation whereby the volume of hydraulic fluid passing through the jack supply circuit is measured by means of a flowmeter which transmits information representing the position of the end of the filler pipe, and this transmitted information is continuously compared with corresponding stored information representing the position of the tank bottom.

The safety system according to the invention comprises a meter for measuring the volume of hydraulic fluid passing through the pipe controlling the introduction movement of the filler pipe, the meter being associated with means for transmitting a number of pulses proportional to the measured volume and representing the position of the end of the filler pipe, and a comparator for comparing the number of pulses transmitted by the meter with a stored number representing the position of the tank bottom.

The invention will now be described with reference to an embodiment thereof, which is given by way of example only with reference to the accompanying drawings.

Figure 1:
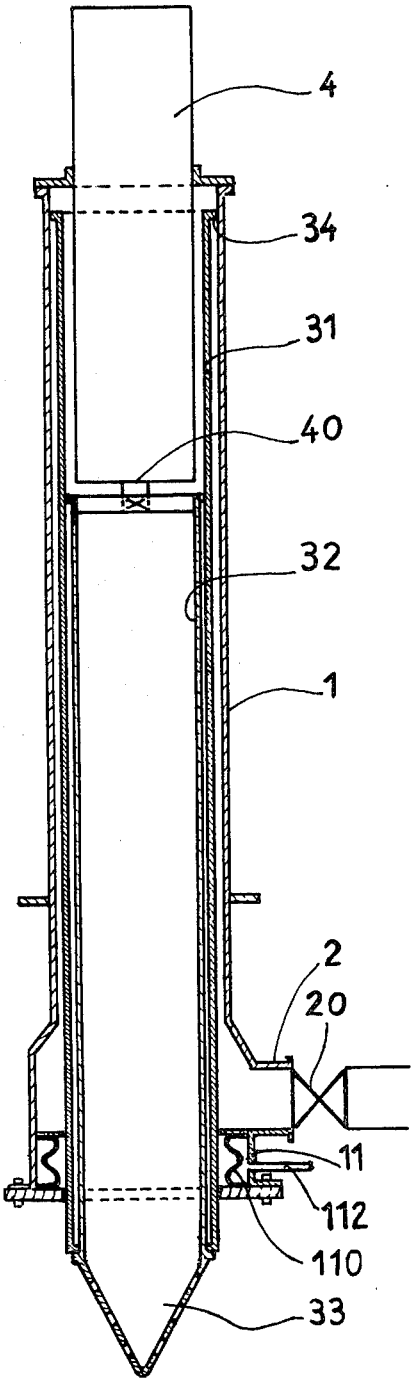
FIG. 1 is a diagrammatic view in section of a tank filler pipe.

The filling pipe shown in FIG. 1 comprises two parts, a fixed part comprising a vertical-axis cylindrical casing 1 to the lower end of which a fluid supply pipe 2 closed by a valve 20 is connected, and a movable part comprising two concentric tubes 31, 32 mounted telescopically inside the casing 1.

The upper part of the inner tube 32 is connected to the rod of a double-acting hydraulic jack 4. The lower part is provided with a strainer 33 and an abutment on which the lower end of the outer tube 31 rests. The upper part of the outer tube 31 is provided with lugs 34 which, when the tube 31 is fully extended, bear on a plinth 11 provided with a gasket 110 disposed in the bottom of the cylindrical casing 1 below the entry of the pipe 2.

The gasket 110 may be of the conventional type arranged to allow the tube 31 to slide. However it is advantageous to use an inflatable gasket, in which case the tube 31 slides along a bore in the plinth 11. The inflatable gasket may be a conventional commercially available type. Since filling installations are generally provided with a pneumatic circuit, e.g. for control of the valves, it is advantageous to control inflation of the inflatable gasket pneumatically by means of a circuit 111 after the tube 31 has descended.

Thus when the jack 4 extends, the tubes 31 and 32 initially descend simultaneously by sliding along the plinth 11 and then when the lugs 34 bear on the gasket 11, descent of the tube 31 stops while the tube 32 continues on its own. In this way, at least during the second part of the movement, the inertia of the moving masses is reduced. There is therefore less risk of damage to the tank from an excessive pressure when the pipe reaches the bottom of the tank.

Figure 2:
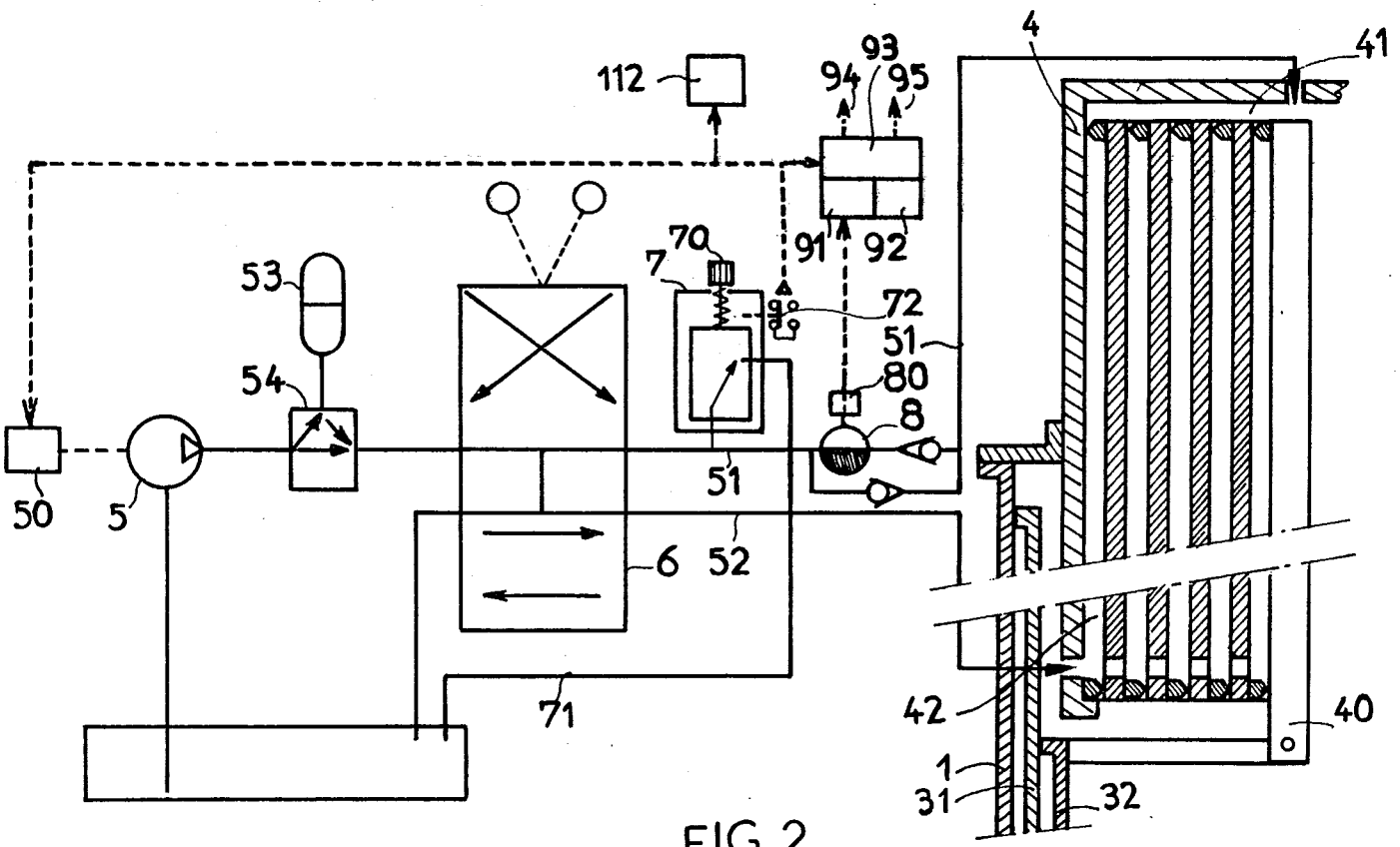
FIG. 2 is a diagrammatic view of a hydraulic circuit for controlling the introduction of the pipe according to the invention.

As shown diagrammatically in FIG. 2, the control jack 4 consists of a number of telescopic elements which extend consecutively, so that the size of the jack and hence of the pipe can be greatly reduced.

The hydraulic circuit for the control of the jack 4 is shown diagrammatically in FIG. 2 and comprises a pump 5 driven by a motor 50 and feeding one of the two chambers 41, 42 of the jack via two pipes 51, 52 through a control distributor 6 which allows automatic or manual control of the upward and downward movement of the filler pipe depending upon which of the pipes 51 and 52 is supplied.

A hydro-pneumatic accumulator 53 shunted upstream of the distributor 6 by means of a make-and-break device 54 allows the filler pipe to be lowered or raised even if the motor and pump are out of operation.

A pressure detector or pressostat 7 is shunted across the supply pipe 51 for the chamber 41 controlling the downward movement of the filler pipe and is adjusted by means of a knob 70 to a pressure threshold which, when exceeded, causes the oil to be fed to the sump via a branch pipe 71 and instantaneously stops the downward movement of the filler pipe. When the pressure threshold, thus adjusted, is exceeded, a contact 72 is triggered and transmits a stop order to the motor 50 to stop the oil supply to the jack. The supply pipe 51 also contains a flowmeter 8 associated with an electrical or mechanical member 80 which transmits an electrical pulse for each unit volume of oil passing through the meter. The number of pulses transmitted by the meter during a given time therefore represents the volume of oil supplied to the chamber 41 and is therefore a function of the extended length of the jack 4 and hence represents the position of the end of the filler pipe inside the tank.

The pulses produced by the member 80 are transmitted to a comparator register 9 which comprises an adding unit 91 for the pulses transmitted by the flowmeter 8, a store 92 in which a given number of pulses is stored, and a comparator 93 which subtracts the number of stored pulses from the number of added pulses.

The comparator register is adjusted according to the size characteristics of the installation. Since the cubic capacity of the filler pipe control jack 4 is known, and since the unit volume corresponding to one pulse is preselected, it is an easy matter to determine the number of pulses corresponding to a given extension of the jack, and hence the position of the end of the filler pipe.

Also, taking into account the characteristics of existing tank waggons, the permissible capacities and the gauges to which designers must work, it is possible to choose a minimum height for the bottom of the tank and determine the number of pulses at the end of which the end of the pipe will reach such level. This number is fed into the store 92.

The height from the base of the tank at which it is possible to open the charging valve without the risk of excessive foaming is also known, and it has been found that this height is greater than the difference between the minimum and maximum heights of the tank bottoms likely to be found. This height, which may be of the order of 30 cm, is converted to a number of pulses which makes up a constant taken into account by the comparator 93.

When the comparator 93 receives a signal transmitted by the triggering of the pressostat 7, the comparator 93 in turn transmits a signal at one of its outputs 94, 95, depending upon the result of the comparison.

If the number of pulses added does not coincide with the number of pulses stored, to within the value of the constant, then this means that the end of the pipe is likely still to be a too high a level above the tank bottom, and the output 95 transmits an acoustic or optical alarm signal so that the operator knows that the filler tube has encountered an obstacle before reaching the tank bottom. In that case the operator will not open the charging valve and will raise the filler pipe and then reintroduce it after slightly changing its position, or will find out the nature of the obstacle.

On the other hand, if the number of pulses added is equal to the number of pulses stored to within the value of the constant, that means that the end of the pipe is at a height which allows filling to take place without any danger, even if the tank bottom is at the minimum height and has not yet been reached.

Output 94 then transmits a signal to authorize the opening of the charging valve. This signal can automatically control the valve opening or alternatively may simply be in the form of a green light indicating to the operator that he can open the valve.

Inflation of the gasket 110 before the valve is opened is also controlled by the same signal by a device 112 which can easily be devised.

In every case, the pump motor 50 is stopped as soon as the pressostat 7 is triggered, so that the pressure on the hydraulic circuit is immediately stopped.

It is of course possible to improve the system in various ways, e.g. by using the authorisation signal transmitted at the output 94 to control the lifting of the filler pipe by a given amount determined by another constant, before the valve is opened.

Of course the invention is not limited to the details of the embodiment described above, but covers all variants thereof and, inter alia, those which differ therefrom only by the use of equivalent means. Nor has it been considered necessary to describe in detail the various devices which may be of any known type, for example the comparator register may be a threshold detector type of electronic unit made up of elements readily available commercially.

What is claimed is:

1. A method of checking the position of a fluid product filler pipe in relation to the bottom of a tank to be filled with the fluid, the method comprising introducing said pipe into said tank, under the control of a double-acting jack controlled by a hydraulic circuit comprising pressure detecting means for stopping movement of said filler pipe into said tank if an obstacle is encountered thereby, measuring the volume of hydraulic fluid passing through said jack supply circuit, transmitting information derived from said measurement and representing the position of the end of said filler pipe, and continuously comparing said transmitted information with corresponding stored information representing the position of said tank bottom.

2. A safety system for a tank filling installation comprising a filler pipe mounted for axial movement, means for supplying fluid to said pipe, a hydraulic double-acting jack for moving said pipe, and a hydraulic jack control circuit comprising two hydraulic fluid supply pipes for supplying the two chambers of said jack for controlling introduction of said filler pipe into a tank and its withdrawl therefrom, respectively, and pressure detecting means shunted across the one of said supply pipes connected to the one of said two chambers of said jack controlling introduction of said pipe for causing stoppage of introduction in the event of a pressure rise due to an obstacle in the path of said pipe, said safety system comprising means for measuring the volume of hydraulic fluid passing through said one supply pipe, pulse transmitting means connected to said measuring means for transmitting a number of pulses proportional to the measured volume and representing the position of the end of said filler pipe, and comparator means for comparing the number of pulses transmitted by said pulse transmitting means with a stored number representing the position of the tank bottom.

3. A safety system according to claim 2, comprising monitoring means for monitoring the introduction of said filler pipe and for stopping the supply of fluid to said filler pipe if the number of pulses transmitted by said pulse transmitting means and said stored number do not coincide to within the value of a constant.

4. A safety system according to either claim 2 or claim 3, wherein said comparator means comprises adding means for adding the number of pulses transmitted by said pulse transmitting means, store means for the number of pulses corresponding to the position of the tank bottom, and comparator means for comparing the number of added pulses with the stored number, said comparator means transmitting a filling authorization signal with the difference between the said numbers is less than a predetermined constant.

5. A safety system according to claim 2, wherein said means for measuring the volume of hydraulic fluid passing through said one supply pipe comprises a flow meter.

* * * * *